US011183764B2

(12) United States Patent
Yang

(10) Patent No.: US 11,183,764 B2
(45) Date of Patent: Nov. 23, 2021

(54) BUTTERFLY PLANAR ANTENNA ELEMENT AND ANTENNA

(71) Applicant: Shenzhen Antop Technology Co. Ltd., Guangdong (CN)

(72) Inventor: Ruidian Yang, Guangdong (CN)

(73) Assignee: SHENZHEN ANTOP TECHNOLOGY CO. LTD., Guangdong (CN)

( * ) Notice: Subject to any disclaimer, the term of this patent is extended or adjusted under 35 U.S.C. 154(b) by 46 days.

(21) Appl. No.: 16/714,071

(22) Filed: Dec. 13, 2019

(65) Prior Publication Data

US 2021/0098883 A1 Apr. 1, 2021

(30) Foreign Application Priority Data

Sep. 27, 2019 (CN) ..... 201921628319.3

(51) Int. Cl.
*H01Q 1/38* (2006.01)
*H01Q 9/04* (2006.01)

(52) U.S. Cl.
CPC ..... *H01Q 9/0414* (2013.01)

(58) Field of Classification Search
CPC ..... H01Q 9/0414; H01Q 13/10; H01Q 1/48
See application file for complete search history.

(56) References Cited

U.S. PATENT DOCUMENTS 6,407,705 B1 * 6/2002 Sanad ..... H01Q 9/0407 343/700 MS
2001/0050651 A1 * 12/2001 Grangeat ..... H01Q 13/106 343/767
2012/0218167 A1 * 8/2012 He ..... H01Q 9/0407 343/872
2016/0218439 A1 * 7/2016 Fasenfest ..... H01Q 21/065

FOREIGN PATENT DOCUMENTS

CN 2938450 Y 8/2007
JP 2006157209 A 6/2006
JP 2014131231 A 7/2014
JP 2015043542 A 3/2015

* cited by examiner

*Primary Examiner* — Dieu Hien T Duong
(74) *Attorney, Agent, or Firm* — Muncy, Geissler, Olds & Lowe, P.C.

(57) ABSTRACT

The present application provides a butterfly planar antenna element and an antenna. The butterfly planar antenna element includes a main radiator and secondary radiators arranged on both sides of the main radiator. A butterfly opening is formed in the main radiator with a symmetrical structure, and includes a first opening arranged in the middle part of the main radiator and four second openings formed by extending outwardly from four corners of the first opening respectively.

9 Claims, 4 Drawing Sheets

| Frequency (MHz) | Lobe Width | Front-to-back Ratio (dB) | First Upper-side Lobe | Maximum Beam | Out-of-roundness (dB) | Maximum Level | Minimum Level | First Lower Secondary |
|---|---|---|---|---|---|---|---|---|
| 500 | 82.21 | 3.93 | 3.94 | 266.87 | 6.85 | 4.82 | -8.88 | 3.94 |

| Frequency (MHz) | Gain (dB) | Minimum Gain (dB) | Co-polarization Maximum Gain (dB) | Cross-polarization Maximum Gain (dB) | Efficiency (dB) |
|---|---|---|---|---|---|
| 500 | 4.89 | -25.92 | 4.87 | -7.69 | -2.13 |

| Frequency (MHz) | Lobe Width | Front-to-back Ratio (dB) | First Upper-side Lobe | Maximum Beam | Out-of-roundness (dB) | Maximum Level | Minimum Level | First Lower Secondary |
|---|---|---|---|---|---|---|---|---|
| 550 | 81.84 | 7.9 | 8.3 | 254.5 | 12.55 | 5.23 | -19.86 | 8.3 |

| Frequency (MHz) | Gain (dB) | Minimum Gain (dB) | Co-polarization Maximum Gain (dB) | Cross-polarization Maximum Gain (dB) | Efficiency (dB) |
|---|---|---|---|---|---|
| 550 | 5.9 | -32.25 | 5.82 | -2.81 | -1.56 |

| Frequency (MHz) | Lobe Width | Front-to-back Ratio (dB) | First Upper-side Lobe | Maximum Beam | Out-of-roundness (dB) | Maximum Level | Minimum Level | First Lower Secondary |
|---|---|---|---|---|---|---|---|---|
| 600 | 74.86 | 11.5 | 11.81 | 257.81 | 7.99 | 6.55 | -9.43 | 11.81 |

| Frequency (MHz) | Gain (dB) | Minimum Gain (dB) | Co-polarization Maximum Gain (dB) | Cross-polarization Maximum Gain (dB) | Efficiency (dB) |
|---|---|---|---|---|---|
| 600 | 7.03 | -28.29 | 6.96 | -1.11 | -0.99 |

BUTTERFLY PLANAR ANTENNA ELEMENT AND ANTENNA

TECHNICAL FIELD

The present invention relates to the technical field of antennas, and specifically relates to a butterfly planar antenna element and an antenna.

BACKGROUND ART

At present, a planar antenna has element type, slot type and other types, and is commonly characterized by being small in volume, light in weight, small in wind resistance and convenient to install and use. A built-in tuner integrates the antenna with the tuner to facilitate the adjustment. The planar antenna is high in efficiency, and is especially suitable for the reception of live satellite television. With the popularization of wireless digital television signals, more and more people receive television signals outdoors or on the move rather than being limited indoors. Even when watching television indoors, the antennas are needed to be installed at different positions in many environments. At this time, higher requirements are placed on the antennas which are tasked with signal reception: wide receiving frequency range, small occupied space, lightweight, being able to be installed in various environments and resistant to various weather, and strong signal receiving capabilities and the like.

However, the existing planar antennas have problems in the impedance of the element and the adaptation of the cable, thereby causing a situation that the planar antenna has a loss in the process of signal transmission, which further causes the problem of unstable signal reception in the UHF band.

SUMMARY

The present invention aims to overcome at least one defect (deficiency) of the above prior art and to solve a problem that the planar antenna element receives signals unstably in the UHF band.

The technical scheme adopted by the present invention is as follows.

A butterfly planar antenna element includes a main radiator and secondary radiators arranged on both sides of the main radiator. A butterfly opening is formed in the main radiator with a symmetrical structure, and includes a first opening arranged in the middle part of the main radiator and four second openings formed by extending outwardly from four corners of the first opening respectively.

Preferably, the main radiator is a rectangular metal sheet, and the secondary radiators are arranged on the long sides of the main radiator.

Preferably, the first opening is in a strip-shaped rectangular structure, and is arranged on the central axis of the short sides of the main radiator.

Preferably, the included angle which is between the two second openings and is formed by extending outwardly from two adjacent corners of the first opening is between 30° and 150°, and more preferably, the included angle is 90°.

The impedance of the planar antenna element can be adjusted by the shape and the size of the butterfly opening so as to be adapted to the coaxial cable connected to the feed hole, match the impedance of the cable, and reduce the reflection loss effect in the signal transmission process. Meanwhile, combined with the arrangement of the secondary radiators, the signal reception of the planar antenna element on 470 to 550 MHz band is enhanced, and the stability of the signal reception is improved.

Preferably, the main radiator is provided with positioning holes to facilitate the installation of the planar antenna element in the antenna box.

Preferably, each short side of the main radiator is provided with arc-shaped notches to facilitate the installation of the planar antenna element.

Preferably, the four ends of the butterfly opening are provided with chamfers, and the design can improve the safety degree when a worker installs and fixes the antenna element.

Preferably, the length of the long sides of the main radiator is 285±0.2 mm, the length of the short sides is 168.8±0.15 mm, and the thickness is 0.4±0.05 mm.

An antenna includes a reflection plate, a radiator arranged on the reflection plate and a feeding line fed for the radiator, in which the radiator includes the above-described butterfly planar antenna element.

Compared with the prior art, the present invention can obtain some beneficial effects. The butterfly planar antenna element and the antenna according to the present invention are simple in structure, convenient to produce and install, high in signal reception quality, wide in signal coverage and more stable in signal reception in the UHF band.

DESCRIPTION OF EMBODIMENTS

Figure 1:
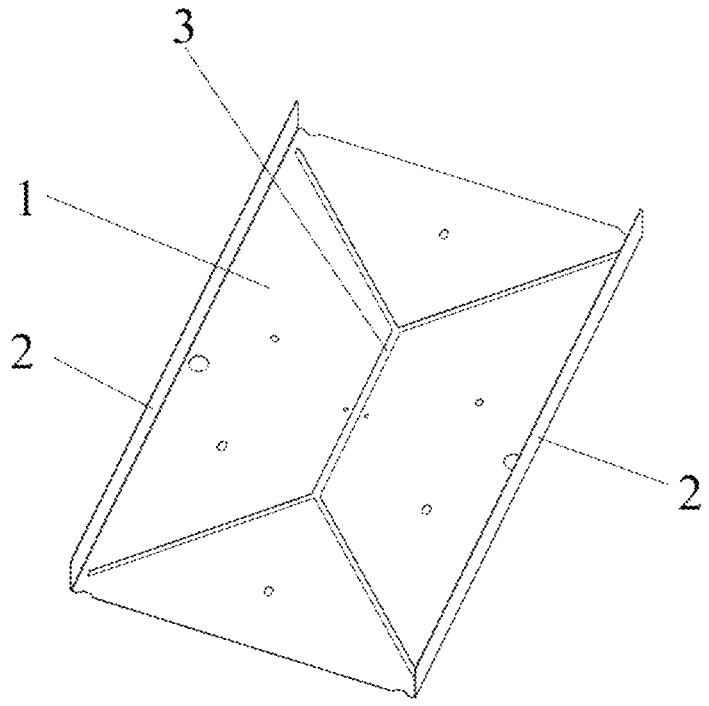
FIG. 1 is a schematic diagram of a butterfly planar antenna element of the present invention.

The drawings of the invention are for illustrative purposes only and are not to be construed as limiting the present invention. In order to better illustrate the following embodiments, certain components of the drawings may be omitted, enlarged, or reduced, and do not represent the dimensions of the actual product. It will be understood that some known structures and descriptions thereof in the drawings may be omitted for those skilled in the art.

As shown in FIG. 1, the present embodiment is a butterfly planar antenna element including a main radiator 1 and secondary radiators 2 arranged on both sides of the main radiator 1. A butterfly opening 3 is formed in the middle part of the main radiator 1 with a symmetrical structure. According to FIGS. 1 and 2, the butterfly opening 3 includes a first opening 4 and four second openings 5 formed by extending outwardly from four corners of the first opening 4 respectively. The first opening 4 is arranged on the central axis of the short sides of the main radiator 1 and is in a strip-shaped rectangular structure.

Figure 2:
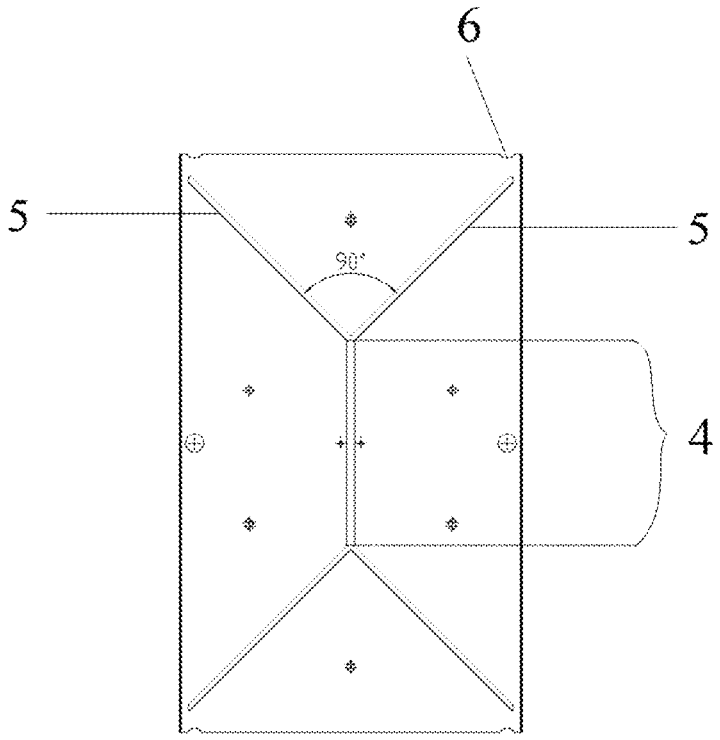
FIG. 2 is a schematic diagram of a main radiator of the butterfly planar antenna element of the present invention.

Preferably, as shown in FIGS. 1 and 2, the included angle which is formed between the two second openings 5 by extending outwardly from two adjacent corners of the first opening 4 is 90°. In other embodiments, the included angle may also be any angle between 30° and 150°.

Preferably, as shown in FIG. 1, the main radiator 1 is provided with positioning holes to facilitate the installation of the planar antenna element in the antenna box.

Preferably, according to FIGS. 1 and 2, each short side of the main radiator 1 is provided with two arc-shaped notches 6 to facilitate the installation of the planar antenna element in the antenna box.

Preferably, according to FIGS. 1 and 2, the four ends of the butterfly opening 3 are provided with chamfers.

Preferably, the main radiator adopts a thick galvanized iron sheet with a thickness of 0.4±0.05 mm.

Figures 3, 4, 5:
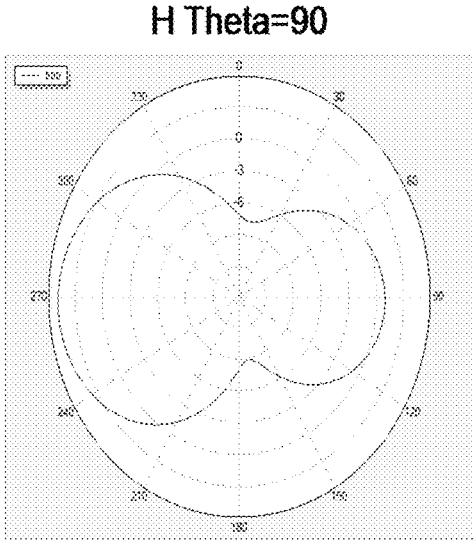
FIG. 3 is an antenna pattern of the present invention.
FIG. 4 is a data schematic diagram of the antenna pattern of the present invention.
FIG. 5 is a data schematic diagram of the antenna pattern of the present invention.

FIGS. 3, 4 and 5 show the test data of the planar antenna element when the frequency is 500 MHz. As can be seen from the data related to the antenna performance in FIGS. 4 and 5, the performance of the planar antenna element is good.

Figures 6, 7, 8:
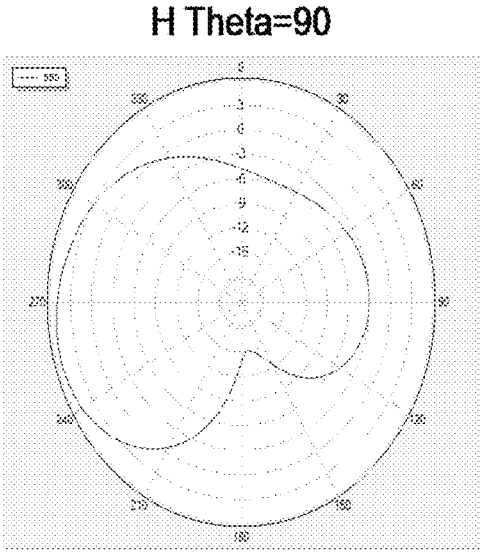
FIG. 6 is an antenna pattern of the present invention.
FIG. 7 is a data schematic diagram of the antenna pattern of the present invention.
FIG. 8 is a data schematic diagram of the antenna pattern of the present invention.

FIGS. 6, 7 and 8 show the test data of the planar antenna element when the frequency is 550 MHz. As can be seen from the data related to the antenna performance in FIGS. 7 and 8, the performance of the planar antenna element is good.

Figures 9, 10, 11:
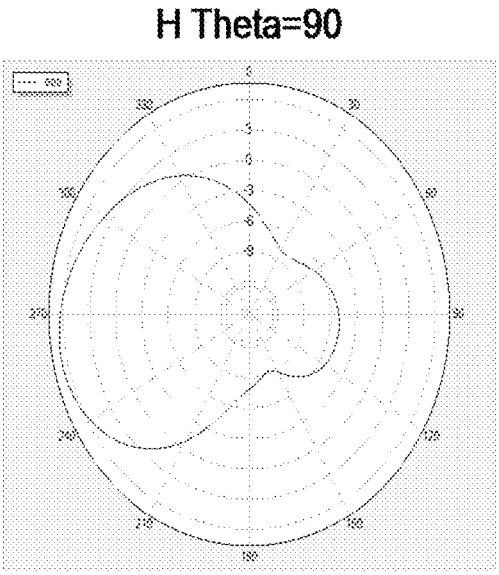
FIG. 9 is an antenna pattern of the present invention.
FIG. 10 is a data schematic diagram of the antenna pattern of the present invention.
FIG. 11 is a data schematic diagram of the antenna pattern of the present invention.

FIGS. 9, 10 and 11 show the test data of the planar antenna element when the frequency is 600 MHz. As can be seen from the data related to the antenna performance in FIGS. 10 and 11, the performance of the planar antenna element is good.

Obviously, the above embodiments of the present invention are merely examples for clear illustration of the invention, and are not intended to limit the implementation of the invention. Any modification, equivalent substitution or improvement and the like within the spirit and principle of the claims of the present invention should be included in the scope of claims of the present invention.

The invention claimed is:

1. A butterfly planar antenna element, comprising: a main radiator and secondary radiators arranged on sides of the main radiator, wherein a butterfly opening is formed in the main radiator with a symmetrical structure and includes a first opening arranged in a middle part of the main radiator and four second openings formed by extending outwardly from four corners of the first opening respectively, wherein an included angle which is between two second openings and is formed by extending outwardly from two adjacent corners of the first opening is between 30° and 150°.

2. The butterfly planar antenna element according to claim 1, wherein the main radiator is a rectangular metal sheet, and the secondary radiators are arranged on long sides of the main radiator.

3. The butterfly planar antenna element according to claim 2, wherein the first opening is in a strip-shaped rectangular structure, and is arranged on a central axis of short sides of the main radiator.

4. The butterfly planar antenna element according to claim 2, wherein each short side of the main radiator is provided with arc-shaped notches.

5. The butterfly planar antenna element according to claim 2, wherein a length of the long sides of the main radiator is 285±0.2 mm and a length of the short sides is 168.8±0.15 mm.

6. The butterfly planar antenna element according to claim 1, wherein the included angle is 90°.

7. The butterfly planar antenna element according to claim 1, wherein four ends of the butterfly opening are provided with chamfers.

8. The butterfly planar antenna element according to claim 1, wherein the main radiator has a thickness of 0.4±0.05 mm.

9. An antenna, comprising: a reflection plate, a radiator arranged on the reflection plate, and a feeding line fed for the radiator, wherein the radiator includes a butterfly planar antenna element according to claim 1.

* * * * *